US005359502A

United States Patent [19]

Cantin

[11] Patent Number: 5,359,502

[45] Date of Patent: Oct. 25, 1994

[54] CHRISTMAS LIGHT STAND

[76] Inventor: Andre Cantin, 3785 St. Samuel Street, Beauport, Quebec, Canada, G1C 4L8

[21] Appl. No.: 140,426

[22] Filed: Oct. 25, 1993

[51] Int. Cl.[5] ..... F21P 1/02

[52] U.S. Cl. ..... 362/123; 362/249; 362/250; 362/252

[58] Field of Search ..... 362/123, 249–252, 362/805

[56] References Cited

U.S. PATENT DOCUMENTS

| | | | |
|---|---|---|---|
| 2,414,866 | 1/1947 | Glaser | 362/123 |
| 4,404,621 | 9/1983 | Mauro | 362/123 |
| 4,620,270 | 10/1986 | Laakso | 362/123 |

*Primary Examiner*—Carroll B. Dority

[57] ABSTRACT

A Christmas light stand device which at night will simulate a lighted Christmas tree and which during daylight hours is unobtrusive and does not obstruct a view therethrough which comprises a plurality of rigid, telescopic, transparent tubular plastic members forming an upwardly converging conical shape; a cylindrical core member at the apex of said conical shape; said core member having a plurality of hinges disposed about the periphery thereof adapted to engage with the upper ends of said tubular members and adjustable horizontal brace members connecting the lower ends of said tubular member one to another to form a rigid structure. The cylindrical core member at the top of the conical shape preferably has a vertically adjustable ornament holder extending upwardly therefrom, while a plurality of wire clips are slidably mounted on said tubular members to engage and hold the wires of conventional electric Christmas lights spirally wrapped therearound. One attractive modification is the provision of lights at the base of the tubes and directed upwardly therethrough. By virtue of the hinged fastening to the top cylindrical core, once the cross braces at the base are telescoped or alternatively removed and the legs telescoped, the device can be stored in a very small space.

5 Claims, 5 Drawing Sheets

CHRISTMAS LIGHT STAND

BACKGROUND OF THE INVENTION

1. Field of the Invention

The present invention relates to Christmas light stand and more particularly pertains to such stands may be utilized, when lighted, to present the appearance of a Christmas tree.

2. Description of the Prior Art

The use of artificial Christmas trees is known in the prior art. More specifically, devices heretofore devised and utilized for the purpose of simulating a Christmas tree are known to consist basically of familiar, expected and obvious structural configurations, notwithstanding the myriad of designs encompassed by the crowded prior art which have been developed for the fulfillment of countless objectives and requirements. More specifically, such prior art devices appear to universally provide a central trunk feature with radiating branches platforms or the like as illustrated in U.S. Pat. Nos. 4,161,768; Des. 325,358; and 3,674,612. Even U.S. Pat. No. 3,104,366 which most closely approximates the device of the present invention has a central trunk member. All of these devices provide a very obvious and not particularly attractive appearance during daylight hours.

In this respect, the device according to the present invention substantially departs from the conventional concepts and designs of the prior art, and in so doing provides an apparatus primarily developed for the purpose of providing an unobtrusive stand essentially unnoticeable in daylight but simulating a Christmas tree at night.

Therefore, it can be appreciated that there exists a continuing need for new and improved Christmas light stand which can be used to simulate Christmas trees. In this regard, the present invention substantially fulfills this need.

SUMMARY OF THE INVENTION

In view of the foregoing disadvantages inherent in the known types of Christmas light stands now present in the prior art, the present invention provides an improved construction wherein the same can be utilized without obstructing daytime vision therethrough. As such, the general purpose of the present invention, which will be described subsequently in greater detail, is to provide a new and improved Christmas light stand which has all the advantages of the prior art devices and none of the disadvantages.

To attain this, the present invention essentially relates to a Christmas light stand device which at night will simulate a lighted Christmas tree and which during daylight hours is unobtrusive and does not obstruct a view therethrough which comprises a plurality of rigid, telescopic, transparent tubular plastic members forming an upwardly converging conical shape; a cylindrical core member at the apex of said conical shape; said core member having a plurality of hinges disposed about the periphery thereof adapted to engage with the upper ends of said tubular members and adjustable horizontal brace members connecting the lower ends of said tubular member one to another to form a rigid structure. The cylindrical core member at the top of the conical shape preferably has a vertically adjustable ornament holder extending upwardly therefrom, while a plurality of wire clips are slidably mounted on said tubular members to engage and hold the wires of conventional electric Christmas lights spirally wrapped therearound. Since the conical shape is formed of transparent plastic tubes and there is no central trunk as in most artificial trees, the device is hardly noticeable in the day time and will not obstruct a view therethrough when positioned on a balcony in front of a window or the like. The telescopic capability of the tubular members not only permits a variation in heights as desired, but also allows the use of the device on uneven ground where adjustment of the individual members will produce the desired symmetrical appearance. One attractive modification is the provision of lights at the base of the tubes and directed upwardly therethrough. By virtue of the hinged fastening to the top cylindrical core, once the cross braces at the base are telescoped or alternatively removed and the legs telescoped, the device can be stored in a very small space.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas light stand which has all the advantages of the prior art devices and none of the disadvantages.

It is another object of the present invention to provide a new and improved Christmas light stand which may be easily and efficiently manufactured and marketed.

It is a further object of the present invention to provide a new and improved Christmas light stand which is of a durable and reliable construction.

An even further object of the present invention is to provide a new and improved Christmas light stand which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved Christmas light stand which provides in the apparatuses of the prior art some of the advantages thereof, while simultaneously overcoming some of the disadvantages normally associated therewith.

Still another object of the present invention is to provide a new and improved Christmas light stand which is of minimum visibility during daylight hours.

Yet another object of the present invention is to provide a new and improved Christmas light stand which is storable in a small area.

Even still another object of the present invention is to provide a new and improved Christmas light stand adjustable to various heights and various terrains.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
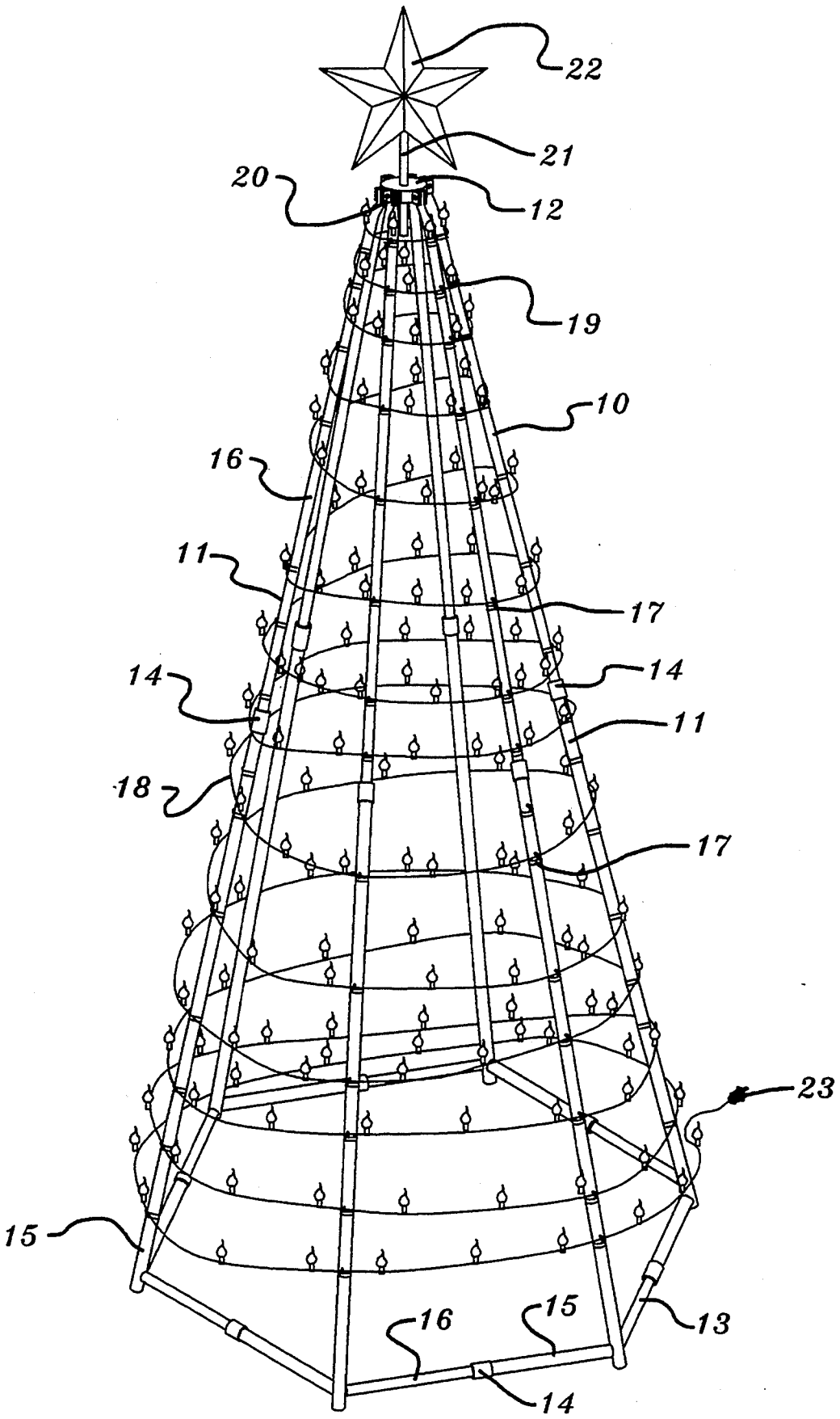
FIG. 1 is a perspective view of the device of the present invention with the lights in place thereon.

With reference now to the drawings, and in particular to FIG. 1 thereof, a new and improved Christmas light stand embodying the principles and concepts of the present invention and generally designated by the reference numeral 10 will be described.

More specifically, it will be noted that the stand device 10 is generally conical in shape and is formed by a plurality of tubular members 11 tapering from an upper cylindrical core member 12 at the apex to a broader base where the tubular members 11 are interconnected by preferably adjustable horizontal brace members 13. These tubular members 11 are formed of a rigid, transparent plastic material such as "LUCITE" or the like and the brace members 13 and core member 12 are preferably formed of the same type of material. As will more clearly be seen in subsequent Figures and described in detail hereinafter, means 14 are provided to permit telescopic adjustment of tubular members 11 and brace members 13 which are each composed of a larger diameter outer tube 15 and a smaller diameter inner tube 16 slidably positioned within tube 15 and extending therefrom. Positioned on said tubular members 11 and slidable thereon are a plurality of wire clips 17 adapted to hold the wire 18 of a string of Christmas tree lights 19 spirally wound on device 10 over substantially its entire length. Tubular members 11 are hingedly connected to the upper cylindrical core member 12 as at 20. Central of core member 12 is a small diameter tube 21 similar to upper tubes 16 extending upwardly therethrough in an adjustable fashion and adapted to support an ornament such as a star 22 thereon. The spirally-wound string of lights 19 is usually made up of multiple strings plugged into one another as is conventional with this type of light and then plugged into an external power source (not shown) as by electrical plug 23.

Figure 2:
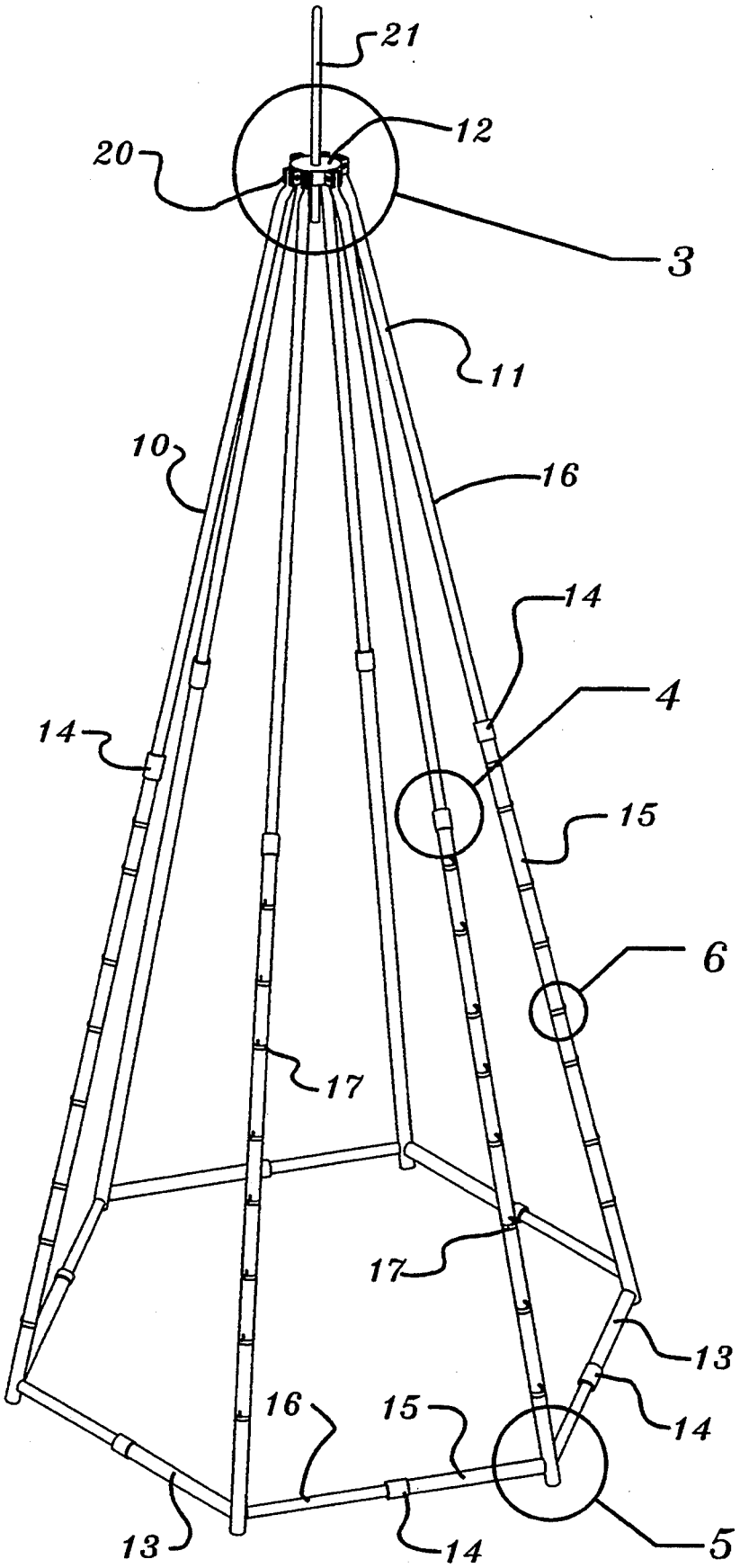
FIG. 2 is a perspective view similar to that of FIG. 1 without the lights and with circled indicia indicating areas shown in the corresponding numbered Figures below.

FIG. 2 shows the same features as FIG. 1 less the light strings 19 and serves to identify the locations of subsequent drawings by the use of numbered circles.

Figure 3:
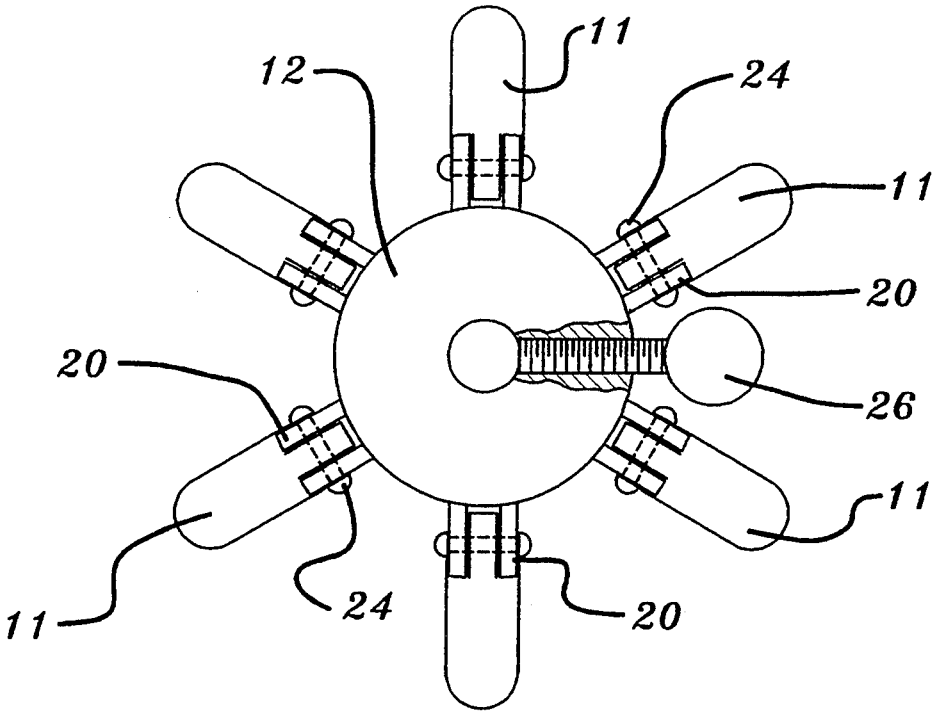
FIG. 3 is an enlarged top plan view of the area on FIG. 2 identified as "3".

FIG. 3 shows in detail the cylindrical core member 12 in circle 3 of FIG. 2. Extending radially from core member 12 are sets of hinge plates 20 to which the upper ends of tubular members 11 are secured by pins 24 passing through such upper end and through the hinge plates 20. This permits tubular members 11 to swing in or out in relation to cylindrical core 12. Extending upwardly through the center of cylindrical core 12 is an adjustable ornament holder 21 comprising a small diameter tube held in the desired position by engagement with a set screw 25 having a thumb screw plate 26 at the outer end thereof.

Figure 4:
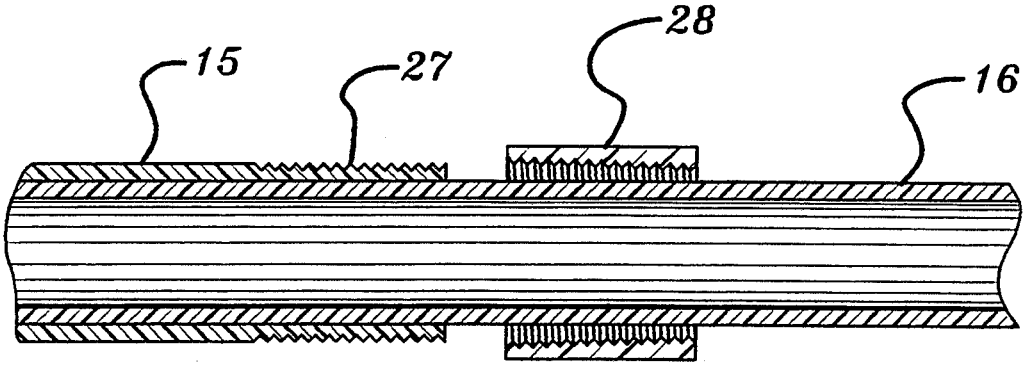
FIG. 4 is a sectional plan view of the area on FIG. 2 identified as "4".

FIG. 4 shows a sectional enlarged view of the telescoping arrangement 14 for the tubular members 11. The same arrangement is used on the horizontal base braces 13 shown in FIGS. 1 and 2. In both instances a larger diameter outer tube 15 has a smaller diameter tube 16 slidably positioned therein. Outer tube 15 has a threaded end 27 which will mate with the threads of collar 28 to compress tube 15 around the inserted tube 16 and fix them in position relative to each other. Loosening collar 28 will permit slidable adjustment of the tubes 15 and 16 to alter the length of the assembly as desired.

Figure 5:
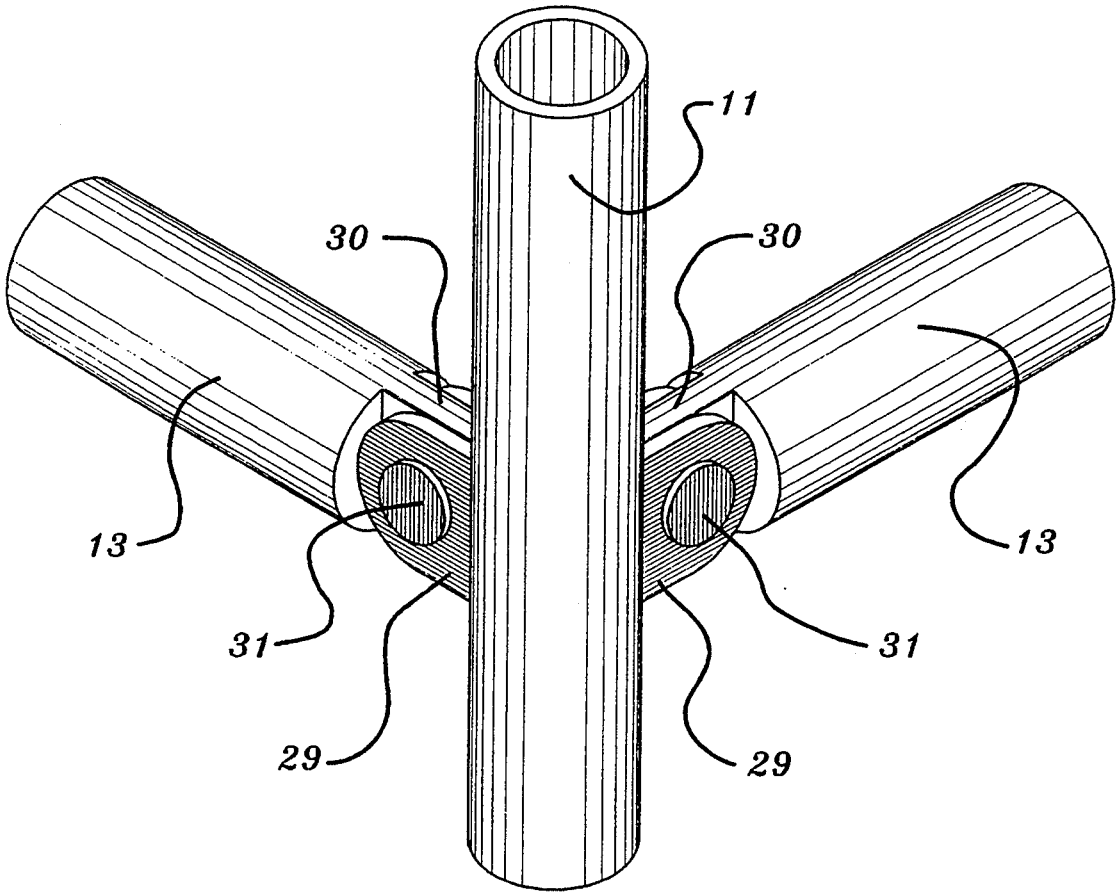
FIG. 5 is an enlarged perspective view of the area on FIG. 2 identified as "5".

FIG. 5 shows the connection of horizontal brace members 13 to the tubular members 11. Sets of projecting plates 29 affixed to the base end of tubular members engage a reduced end 30 of brace members 13 therebetween and a pin 31 holds the assembly together. Pin 31 may be designed for easy removal should it be desired to take out brace members 13 completely rather than telescopically reducing their length as described above in order to reduce storage size.

Figure 6:
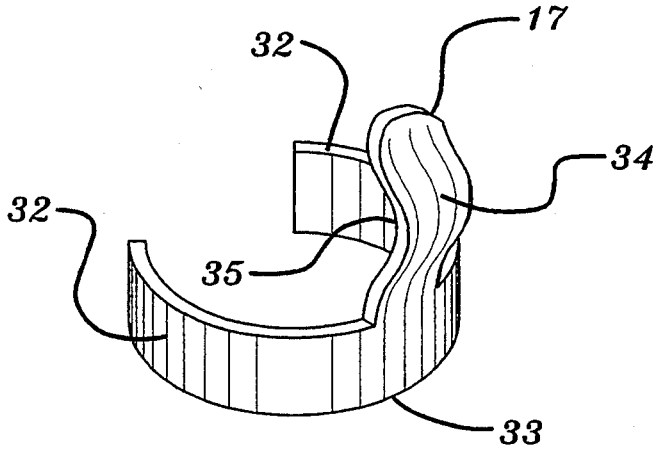
FIG. 6 is an enlarged perspective view of a wire clip identified at "6" in FIG. 2.

FIG. 6 is a detail view of one of the multiple wire clips 17 used to affix the Christmas tree light wires. Clip 17 consists of a thin springy plastic member having a pair of arms 32 open at the outer end and of a size to snugly engage tubular member 11. Due to the springy nature of the arms 32 the same clip 17 may be used to engage with both tubes 15 and 16 of such tubular members 11. The back side 33 of clip 17 has an upwardly extending arm 34 which has a bowed configuration with the recess 35 of such bow being adapted to accept a Christmas tree light wire and to press it snugly against the tubular member 11 when clip 17 is snapped thereon.

Figure 7:
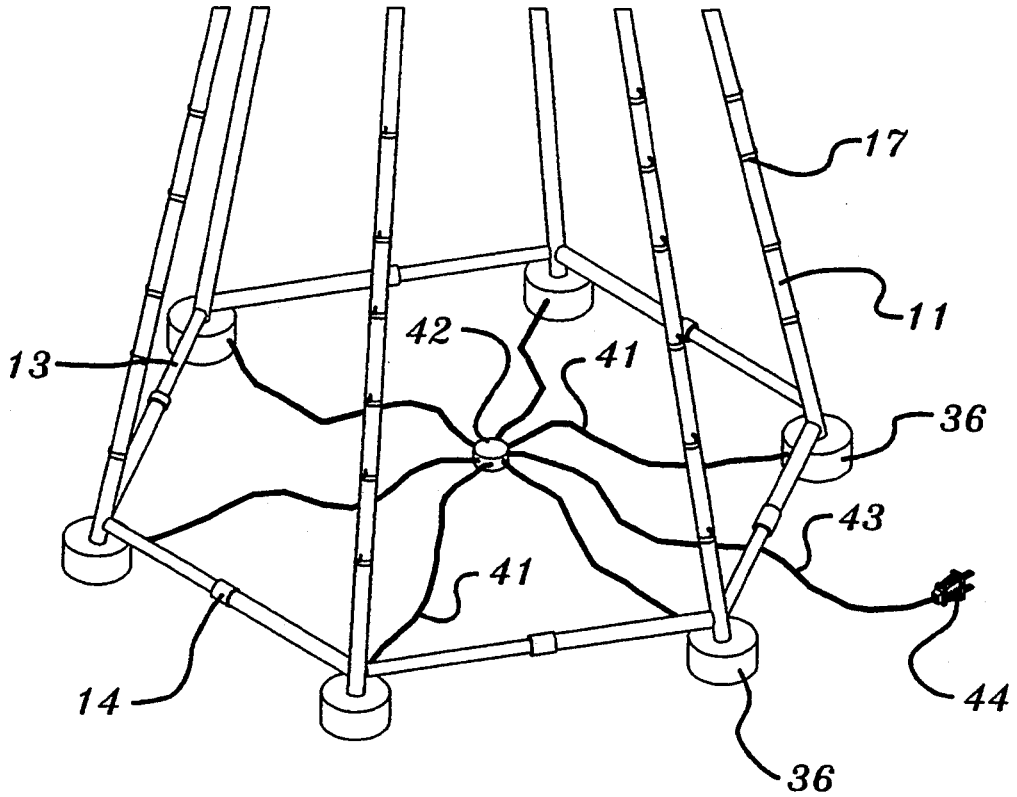
FIG. 7 is a partial perspective view showing a modification to the base of the device of the preceding drawings.
Figure 8:
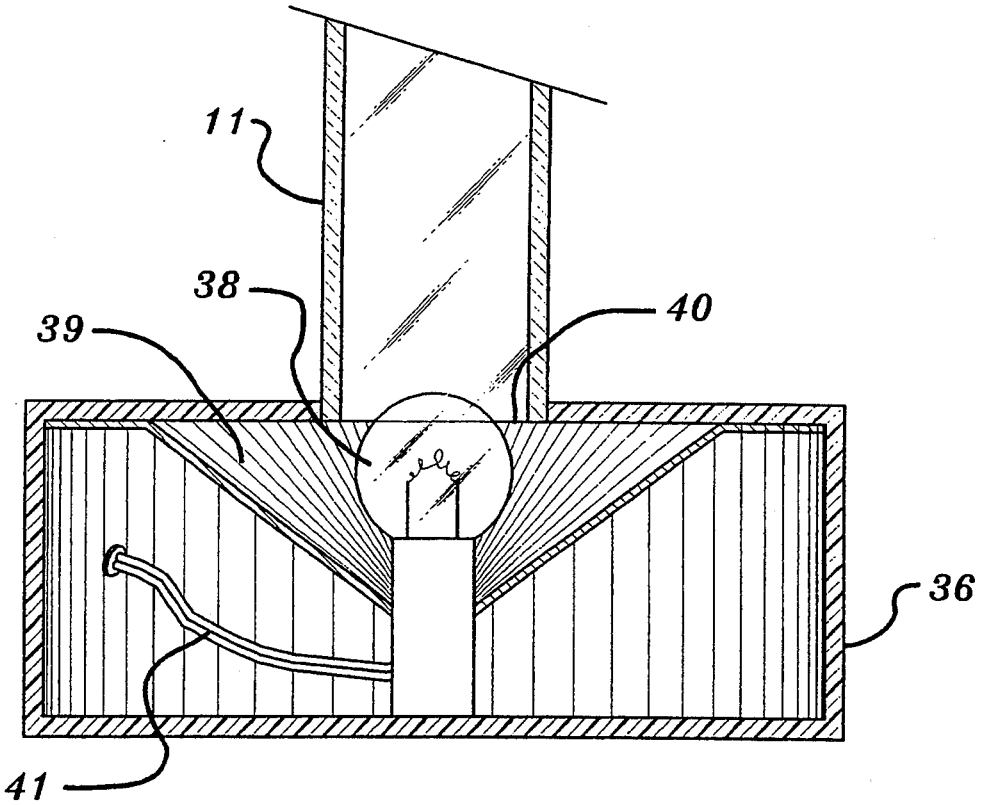
FIG. 8 is an enlarged sectional view of one of the bases shown in FIG. 7.

FIGS. 7 and 8 relate to a decorative modification for the device 10 of the earlier drawings. This comprises the addition of cylindrical base supports 36 for each tubular member 11. Base supports 36 are hollow and cylindrical in shape and, in effect, provide light boxes designed to project light up through the transparent tubular members 11. As shown in FIG. 7, base support 36 has a light source 38 mounted centrally therein with an upwardly directed reflector 39 positioned therearound to project the light from source 38 up into tubular member 11 which is secured (as by adhesive or the like) in open communication with an opening 40 in the top surface of support 36. As shown in FIG. 7, preferably the wires 41 for energizing the light sources 38 are run from each base support 36 to a central distribution box 42 from which a wire 43 is run to a plug 44 for use with an external power source (not shown).

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved Christmas light stand comprising: an upper small diameter cylindrical core; a plurality of adjustable length tubular members formed of transparent, rigid plastic hingedly connected around said cylindrical core and depending downwardly therefrom to form a substantially conical shape; a plurality of length-adjustable horizontal brace members connecting the base portion of said tubular members one to another; and a plurality of wire clips slidably positioned on said tubular members said clips adapted to engage the wiring of a string of Christmas lights strung spirally around said tubular members.

2. A stand as in claim 1 wherein said tubular transparent members and said horizontal braces are each formed of an outer tube; an inner smaller diameter tube slidably positioned in said outer tube; and a clamping device positionable on said outer tube to clamp it against said inner tube to prevent relative movement between such tubes.

3. A stand as in claim 1 wherein said cylindrical core has a small diameter tube adjustably extending upwardly through the center thereof, said small diameter tube providing a support for a Christmas tree decoration thereon.

4. A stand as in claim 1 wherein said cylindrical core, said tubular members, said brace members and said wire clips are all formed of rigid, transparent plastic.

5. A stand as in claim 1 wherein the bases of said transparent tubular members terminate in a hollow cylinder affixed thereto; a light source within each of said hollow cylinders; and reflector means within said hollow cylinders directing the light from said light source upwardly into each transparent tubular member.

* * * * *